US005924366A

United States Patent [19]

Trainer et al.

[11] Patent Number: 5,924,366

[45] Date of Patent: Jul. 20, 1999

[54] SIDE FRAME PEDESTAL ROOF WITH ROCKER SEATS

[75] Inventors: Kenneth W. Trainer; Mark R. Carifa, both of Reynoldsburg, Ohio

[73] Assignee: Buckeye Steel Castings, Columbus, Ohio

[21] Appl. No.: 09/049,746

[22] Filed: Mar. 27, 1998

[51] Int. Cl.[6] ..... B61F 5/00

[52] U.S. Cl. ..... 105/206.1; 105/218.1; 105/223; 105/225

[58] Field of Search ..... 105/206.1, 218.1, 105/219, 220, 221.1, 223, 224.05, 224.1, 225

[56] References Cited

U.S. PATENT DOCUMENTS

| | | | |
|---|---|---|---|
| 1,642,695 | 9/1927 | McCullough | 105/220 |
| 1,779,526 | 10/1930 | Barrows | 105/220 |
| 1,859,265 | 5/1932 | Brittain et al. | 105/223 |
| 2,418,398 | 4/1947 | Cottrell | 105/223 |
| 3,897,736 | 8/1975 | Tack | 105/225 |
| 4,203,371 | 5/1980 | Tack | 105/225 |
| 5,425,312 | 6/1995 | Tack | 105/225 |

*Primary Examiner*—Mark T. Le
*Attorney, Agent, or Firm*—Banner & Witcoff, Ltd.

[57] ABSTRACT

A side frame for a railway car is disclosed comprising a pedestal jaw and an integral crown shaped pedestal jaw roof. A liner matching the shape of the crowned pedestal jaw roof is removably mounted to the pedestal jaw roof. In operation, the crown shaped pedestal jaw roof and snap-on liner reduce wear on the pedestal jaw roof and permit swinging of the side frames relative to the railcar axles. The integral crown shaped pedestal roof and snap-on liner eliminate the traditional rocker seat, shims, and welded retainers, thereby reducing the maintenance and cost of traditional side frames.

13 Claims, 3 Drawing Sheets

FIG.1
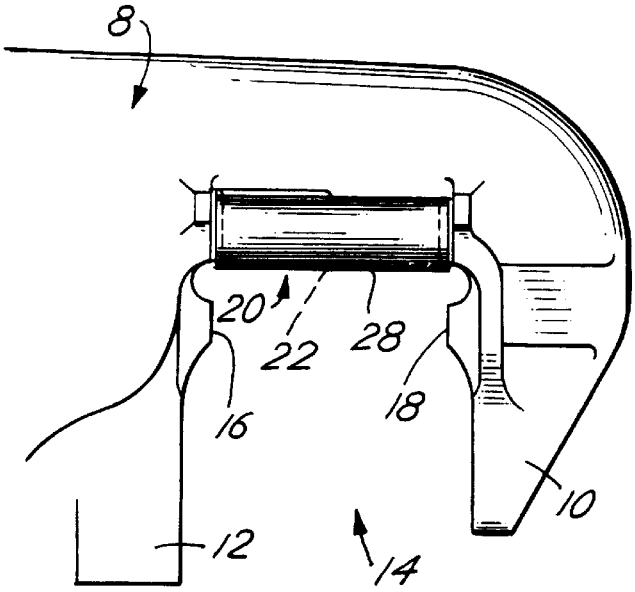
FIG.2
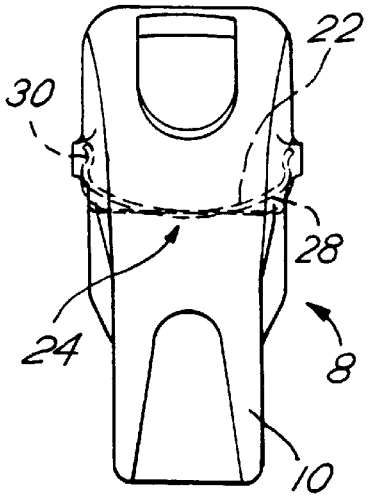
FIG.3
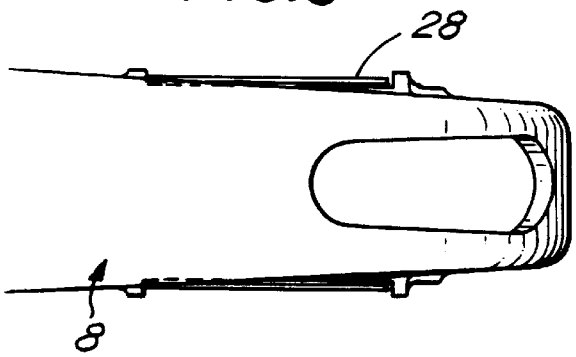
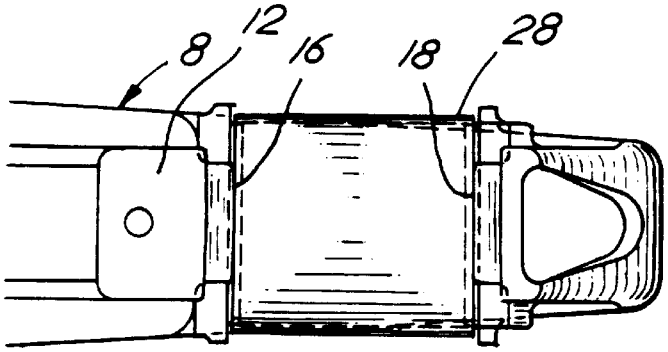
FIG.4

SIDE FRAME PEDESTAL ROOF WITH ROCKER SEATS

BACKGROUND OF THE INVENTION

1. Field of Invention

The present invention relates in general to improved trucks for railway cars. More specifically, but without restriction to the particular use which is shown and described, this invention relates to truck side frames that have a crowned pedestal roof.

2. Description of the Related Art

It is known that railcar trucks are the wheeled structures that support the weight of the railcar body and ride on the railroad track. As conventional, two trucks are used beneath and at each end of the railcar body. A common type of railcar truck used in freight service is the three-piece truck which comprises two parallel side frames and a truck bolster that transverses the side frames. Typically, the bolster, at each end, extends into bolster openings defined by each side frame and is supported by the side frames. The side frames and truck bolster are supported on at least two longitudinally spaced wheelsets. Each wheelset includes transversely spaced wheels that are joined by a transversely extending axle having axle ends mounted in respective bearing adapters.

The transversely spaced side frames are usually cast and comprise a bolster opening, an elongated lower tension member, and an elongated top compression member which defines longitudinally spaced, downwardly opening pedestal jaws on each end. The jaws are adapted to receive the bearing adapters which rotatably receive the journal portions of the axles. Thus, the wheel sets and side frames are mounted together by the bearing adapters.

The pedestal jaw further defines a pedestal jaw roof and a downwardly extending bracket. The pedestal jaw roof typically defines a cavity to accommodate it a crown shaped block of hardened steel that is inserted in the cavity with the crowned surface extending out from the pedestal roof. Two spacers or shims are located between the sides of the crowned block and the walls formed by the cavity. These spacers eliminate the gap between the crowned block side walls and the pedestal jaw cavity to allow the block member to fit snug within the cavity. Two retainers are welded in position to hold the block member in the cavity. Advantageously, in service, the crowned block member permits the side frame to swing or sway relative to the axle about the longitudinal axis of the side frame. Moreover, this crowned block member reduces wear in the pedestal roof. The crowned block, after it is worn, can be replaced by removing the retainers and rewelding a new crowned block member.

However, numerous components are used to form the crowned pedestal roof to permit swinging of the side arm: the block member, the two spacers, and the two retainers. In addition, removing the welded rocker seat requires significant maintenance, and replacing the crowned block and/or retainers can be costly.

SUMMARY OF THE INVENTION

Accordingly, an object of the present invention is to eliminate the separate components that form the crowned pedestal roof Another object of the present invention is to reduce wear in the pedestal roof and still allow swinging of the side frame. Yet another object of the invention is to reduce the cost and maintenance of the traditional crowned pedestal roof. Still another object is to cast a crown integral with the pedestal roof. Yet another object of the invention is to use a hardened snap-on liner to reduce wear on the pedestal roof.

Briefly stated, in summary, the present invention involves a railcar truck assembly comprising at least two longitudinally spaced, transversely extending axles, with wheels mounted to the axles. A pair of transversely spaced longitudinally extending side frames are mounted to the axles and a transversely extending bolster is mounted to the side frames. The transversely spaced longitudinally extending side frames define a pedestal jaw, a bracket and a crown shaped pedestal jaw roof. A liner is removably mounted to the crown shaped pedestal jaw roof. The liner is also crown shaped and snaps onto the pedestal jaw roof. In operation, the crown shaped pedestal jaw roof and the liner reduce wear on the pedestal jaw roof and permit swinging of the transversely spaced longitudinally extending side frames. Significantly, the integral crown shaped pedestal roof and liner eliminate the traditional block member, shims, and welded retainers, thereby reducing the maintenance and cost of traditional side frames.

The full range of objects, aspects and advantages of the invention are only appreciated by a full reading of this specification and a full understanding of the invention. Therefore, to complete this specification, a detailed description of the invention and the preferred embodiment follows, after a brief description of the drawing.

BRIEF DESCRIPTION OF THE DRAWING

The preferred embodiment of the invention will be described in relation to the accompanying drawing. In the drawing, the following figures have the following general nature:

FIG. 1 is a side elevation view of the end of the side frame of the present invention.

FIG. 2 is an end elevation view of the side frame of FIG. 1.

FIG. 3 is a top plan view of the side frame of FIG. 1.

FIG. 4 is a bottom plan view of the side frame of FIG. 1.

In the accompanying drawing, like reference numerals are used throughout the various figures for identical structures.

DESCRIPTION OF THE PREFERRED EMBODIMENTS

Figure 5:
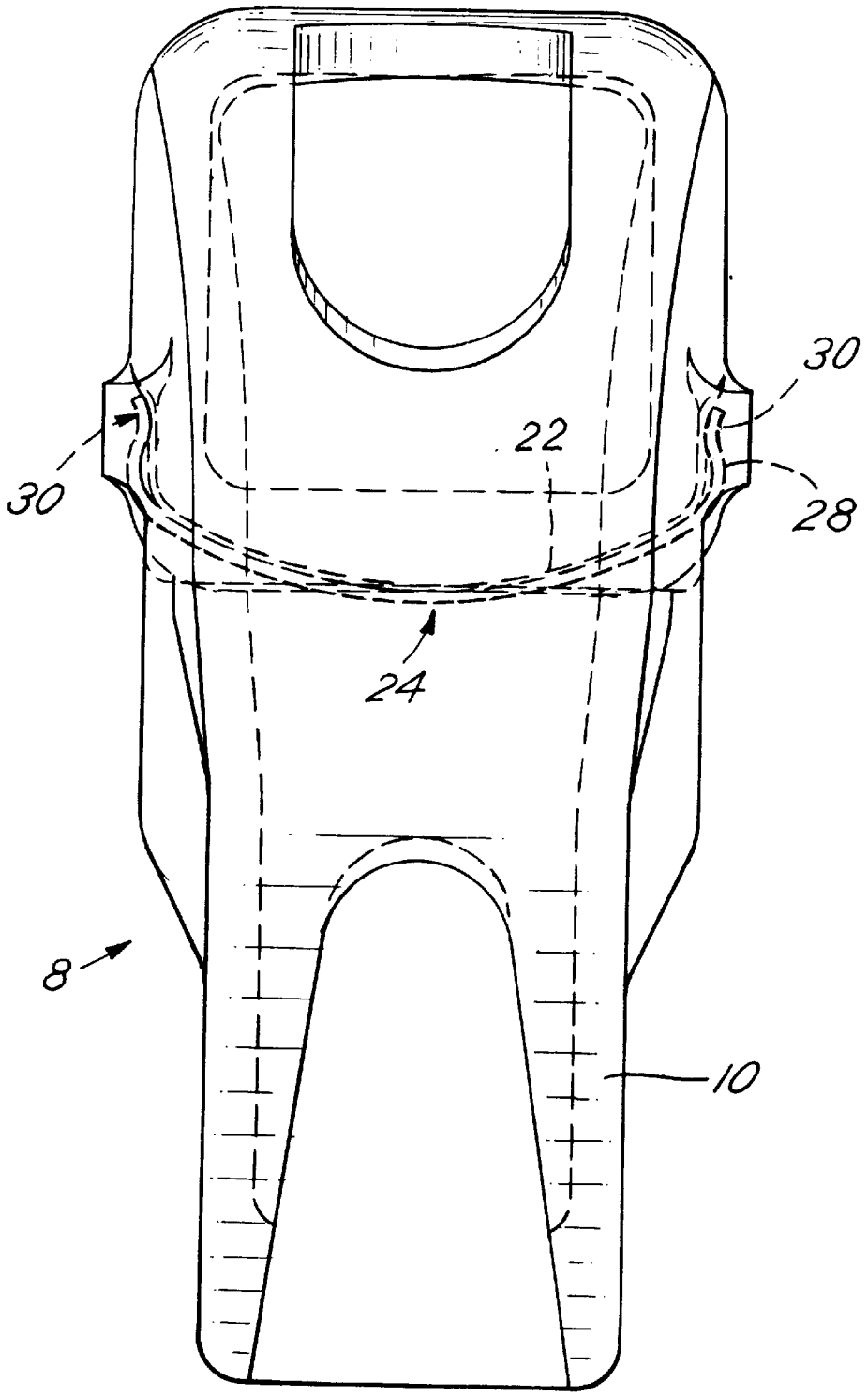
FIG. 5 is an enlarged end elevation view of the side frame of FIG. 2.

It will be understood to those skilled in the art that the drawings show only a fragmentary portion of a railway truck, which includes a pair of laterally spaced side frames supported on wheel and axle assemblies, and a bolster connected between the side frames for supporting the car body. Referring to FIG. 1, there is shown the end of a side frame 8 incorporating the features of the present invention. The side frame, at each end, includes a downwardly extending pedestal jaw 10 and an integral bracket 12. The pedestal jaw 10 and bracket 12 together define the axle-accommodating pedestal opening 14 wherein the bearing adapters of the railcar wheels are mounted.

It is also understood to those skilled in the art that a wheel bearing is carried on the axle near the end thereof, and a railcar bearing adapter is provided between the outside of the bearing and the pedestal opening 14. Within the pedestal opening 14 is a pedestal jaw roof 20 and bearing adapter thrust lugs 16 and 18 for retaining the railcar bearing adapter. The bearing adapter is retained at its sides by the thrust lugs 16, 18 with the pedestal jaw roof 20 positioned over the bearing adapter. The pedestal jaw roof traditionally defines a cavity or rocker seat for receiving a crowned block member which typically is held in place by welded retainers. Shims or spacers are customarily used between the block member and cavity walls to provide a better fit. The crowned block member has a convex shape that extends downwardly into the pedestal opening and abuts the top of the bearing adapter. The convex or crowned shape of the block member permits the side frame to swing or sway relative to the axle about the side frame's longitudinal axis, thereby reducing wear on the side frame. Typically, when the block member became worn, losing its crowned profile, the block member and accompanying shims were replaced by removing the welded retainers and installing a new block member and necessary shims. The new block member would again be held in place by rewelding retainers. This process is necessary for each worn block member. The maintenance and cost disadvantages of retrofitting new block members are obvious and need no further explanation.

As shown in FIGS. 1, 2, and 5, the pedestal jaw roof 20 of the present invention defines an integral crowned rocker seat 22. The rocker seat 22, in cross-section, is convex shaped or U-shaped and extends downwardly into the pedestal opening 14. The crowned rocker seat 22 replaces the block member, shims, and welded retainers, thereby eliminating the cost and retrofitting time needed to replace the same. Referring to FIGS. 2 and 4, the rocker seat 22 is crowned laterally across the width of the side frame 8 with the apex 24 of the crown extending downwardly in the pedestal opening the same distance as the traditional crowned block member.

Figure 6:
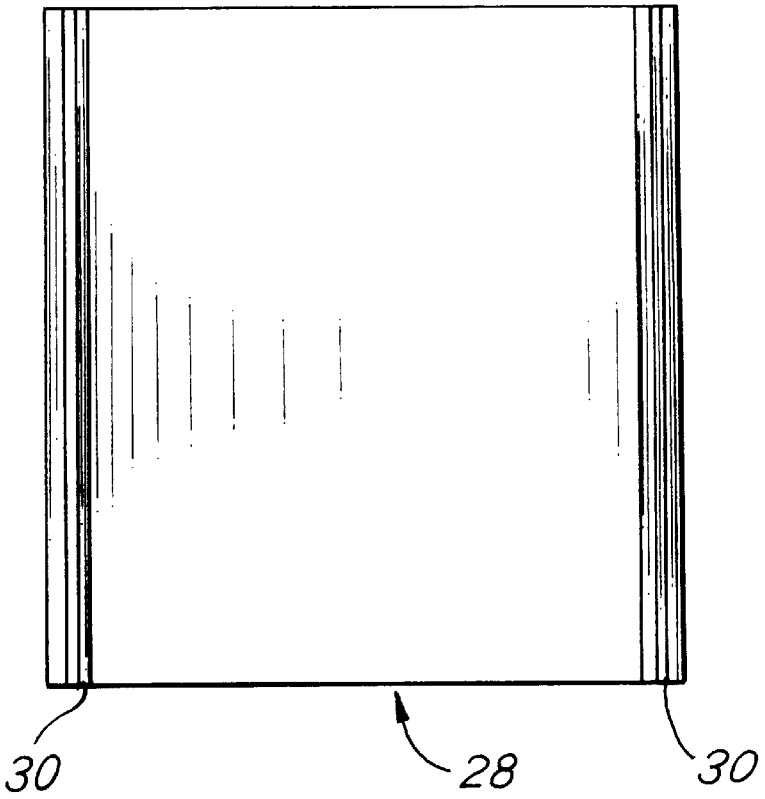
FIG. 6 is a side elevation view of the liner of the present invention.
Figure 7:
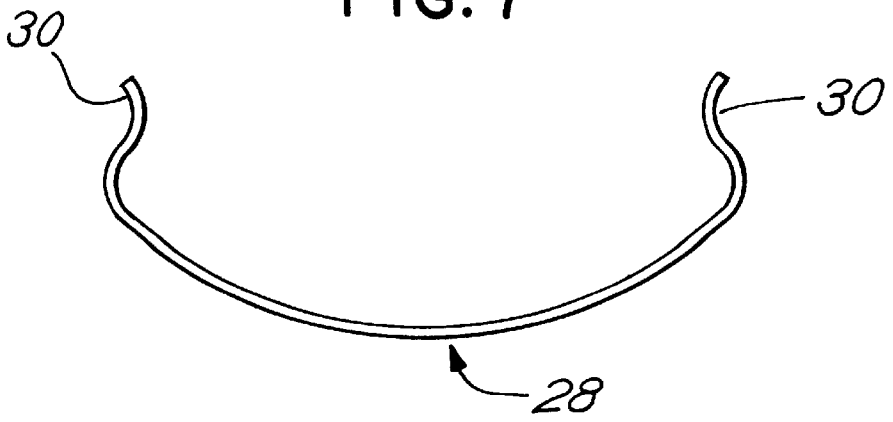
FIG. 7 is a bottom plan view of the liner of FIG. 6.

In a preferred embodiment and as exemplified in FIGS. 5, 6, and 7, liner 28 is removably mounted to the crowned rocker seat 22 to cover and protect the rocker seat. The liner 28 is similar to the wear plate disclosed in U.S. Pat. No. 4,203,371, which is incorporated by reference, and is shaped and configured to match the crowned profile of the rocker seat 22. Being thin and made of a hardened steel, the liner 28 is not only wear resistant but also flexible along the longitudinal center of the liner. This flexibility or resiliency allows the liner 28 to snap onto the crowned rocker seat 22 for easy installation. The liner 28 further defines S-shaped ends 30 that are adapted to resiliently clamp inward toward one another against the opposite side surfaces of the pedestal roof 20, that is, the S-shaped ends permit the liner to snap onto the pedestal roof. The S-shaped ends also serve as a retainer when the liner is snapped onto the rocker seat 22 over a ridge or lip on the side frame 8 adjacent the rocker seat 22. The clamping action of the S-shaped ends against the side frame serve to minimize side-to-side movement of the wear plate relative to the frame. In use, the hardened liner 28 resists wear on the rocker seat 22 and is easily replaced by simply snapping off the worn liner and replacing the worn liner with a new liner.

The preferred embodiments of the invention are now described as to enable a person of ordinary skill in the art to make and use the same. Variations of the preferred embodiment are possible without being outside the scope of the present invention. Therefore, to particularly point out and distinctly claim the subject matter regarded as the invention, the following claims conclude the specification.

What is claimed is:

1. A railcar truck assembly comprising transversely spaced longitudinally extending side frames, the transversely spaced longitudinally extending side frames defining a pedestal jaw, a bracket and a pedestal jaw roof defining a downwardly extending crown, a liner removably mounted to the crown of the pedestal jaw roof, whereby the crown of the pedestal jaw roof and the liner reduce wear on the pedestal jaw roof and permit swinging of the transversely spaced longitudinally extending side frames.

2. The railcar truck assembly as in claim 1 wherein the liner is shaped to match the shape of the pedestal jaw roof.

3. The railcar truck assembly as in claim 1 wherein the liner is made of a hardened steel.

4. A railcar truck having transversely spaced longitudinally extending side frames, the railcar truck comprising:

a pedestal jaw roof defining an integral rocker seat, the integral rocker seat being convex in shape and extending downward; and a liner removably mounted to the integral rocker seat, whereby the integral rocker seat and the liner reduce wear on the pedestal jaw roof and permit swinging of the transversely spaced longitudinally extending side frames.

5. The railcar truck as in claim 4 wherein the integral rocker seat is crown shaped, the crown of the rocker seat extending downward.

6. The railcar truck as in claim 4 wherein the liner is shaped to match the shape of the integral rocker seat.

7. The railcar truck as in claim 4 wherein the liner is made of a hardened steel.

8. The railcar truck as in claim 4 wherein the liner is snap-fitted onto the integral rocker seat.

9. A railcar truck side frame having an elongated lower tension member, an elongated top compression member, and a pedestal jaw defining a pedestal jaw opening, comprising:

a pedestal jaw roof defining an integral crowned rocker seat, the crown of the rocker seat extending downward into the pedestal jaw opening; and a liner snap fitted onto the integral crowned rocker seat, whereby the integral crowned rocker seat and the liner reduce wear on the pedestal jaw roof and permit swinging of the side frame.

10. The railcar truck as in claim 9 wherein the integral crowned rocker seat is U-shaped.

11. The railcar truck as in claim 9 wherein the integral crowned rocker seat laterally transverses the pedestal jaw roof.

12. The railcar truck as in claim 9 wherein the liner is shaped to match the shape of the integral crowned rocker seat.

13. The railcar truck as in claim 9 wherein the liner is made of a hardened steel.

* * * * *